United States Patent [19]

Masters

[11] Patent Number: 4,660,806

[45] Date of Patent: Apr. 28, 1987

[54] PUSH STICK FOR PLUMB AND LINE ADJUSTMENT OF STUD WALLS

[76] Inventor: Scott A. Masters, P.O. Box 141, Solana Beach, Calif. 92075

[21] Appl. No.: 775,224

[22] Filed: Sep. 12, 1985

[51] Int. Cl.[4] ..... B66F 3/24

[52] U.S. Cl. ..... 254/11; 254/35; 254/93 R; 254/134

[58] Field of Search ..... 254/11, 35, 93 R, 133, 254/134, 133 A, 2 R, 2 B, 2 C, 100, 934; 405/282

[56] References Cited

U.S. PATENT DOCUMENTS

| | | | |
|---|---|---|---|
| 737,133 | 8/1903 | O'Brien | 254/133 A |
| 1,482,846 | 2/1924 | Harrah | 254/133 R |
| 2,200,133 | 5/1940 | Mandl | 254/93 H |
| 2,583,945 | 1/1952 | Jacobs | 254/133 R |
| 2,762,599 | 9/1956 | Faris | 254/100 |
| 2,764,215 | 9/1956 | Adams et al. | 254/133 R |
| 2,960,309 | 11/1960 | Swanson | 254/133 R |
| 3,143,335 | 8/1964 | Lassahn | 254/11 |
| 3,851,856 | 12/1974 | Berg | 254/93 R |
| 3,945,610 | 3/1976 | Solie et al. | 254/93 R |
| 4,148,462 | 4/1979 | Jessup | 254/133 R |

*Primary Examiner*—Robert O. Watson
*Attorney, Agent, or Firm*—Baker, Maxham & Jester

[57] ABSTRACT

Telescopically slidable tubular members incorporate a hydraulic jack for causing successive minute amounts of relative longitudinal extension thereof. The jack includes a hydraulic piston and cylinder mounted to the rear end of the forward tubular member. This assembly engages a pin inserted in a selected one of a plurality of longitudinally spaced holes in the forward end of the rear tubular member to thereby provide an initial overall length adjustment. A pump is removably mounted to the rear tubular member and is connected to the piston and cylinder assembly via hoses. The telescoping members are positioned diagonally so that a spade at the forward end of the forward tubular member engages an upper portion of a generally vertically oriented stud wall and so that a toothed base member pivotally connected to the rear end of the rear tubular member engages the floor. A carpenter can then remove and remotely operate the pump by hand to move the stud wall and thereby safely accomplish plumb and line adjustments.

14 Claims, 3 Drawing Figures

PUSH STICK FOR PLUMB AND LINE ADJUSTMENT OF STUD WALLS

BACKGROUND OF THE INVENTION

The present invention relates to construction tools used by carpenters, and more particularly, to a device for aiding framers accomplish the plumb and line functions normally required before framed stud walls are permanently secured in place.

In the construction of residential dwellings and other wood framed buildings, stud walls are first constructed on the floor or other foundation and they are all tilted vertically and temporarily supported in position. Each stud wall comprises a plurality of vertically extending, spaced apart wood studs connected at their upper and lower ends by horizontally extending boards called plates. Before the stud walls are permanently nailed together each wall must be plumbed and lined. Plumb refers to the precise vertical positioning of the stud wall and line refers to the precise positioning of the stud wall, i.e. so that it extends in a straight line without bending or curving. Pushing the stud wall to plumb is called racking.

The conventional method of performing the plumb and line functions requires two carpenters. The first carpenter holds a pry board diagonally between the floor and the upper portion of the stud wall. The second carpenter holds a level against the stud wall or looks down the stud wall from the end and instructs the first carpenter to kick, push or otherwise move the diagonal pry board until it moves the stud wall into the required position. Clearly this is a tedious job in that the pry board has a tendency to slip from engagement with the stud wall and minute incremental movements of the pry board are difficult. The pry board can break and cause injury. The movements of the pry board by the first carpenter are done in response to the verbal commands of the second carpenter without a clear idea of exactly how much additional movement is required. The utilization of two carpenters leads to excessive labor costs. The pry boards must be replaced frequently due to warping and breakage, and this results in added material costs. Also, the accuracy of this conventional method of plumb and line adjustment is subject to wide variations, thereby resulting in walls that are not "true" and which must be re-aligned to avoid improper door and window fittings and visual inconsistencies.

SUMMARY OF THE INVENTION

It is the primary object of the present invention to provide a apparatus for facilitating plumb and line adjustment of framed stud walls.

It is another object of the present invention to provide such an apparatus which will enable a single carpenter to perform the plumb and line functions with considerable ease and accuracy.

It is another object of the present invention to provide such an apparatus that has a simple, lightweight, durable construction.

It is another object of the present invention to provide such an apparatus that can be used ot accomplish plumb and line adjustment of stud walls on a safer basis.

According to the illustrated embodiment of my invention telescopically slidable tubular members incorporate a hydraulic jack for causing successive minute amounts of relative longitudinal extension thereof. The jack includes a hydraulic piston and cylinder mounted to the rear end of the forward tubular member. This assembly engages a pin inserted in a selected one of a plurality of longitudinally spaced holes in the forward end of the rear tubular member to thereby provide an initial overall length adjustment. A pump is removably mounted to the rear tubular member and is connected to the piston and cylinder assembly via hoses. The telescoping members are positioned diagonally so that a spade at the forward end of the forward tubular member engages an upper portion of a generally vertically oriented stud wall and so that a toothed base member pivotally connected to the rear end of the rear tubular member engages the floor. A carpenter can then remove and remotely operate the pump by hand to move the stud wall and thereby safely accomplish plumb and line adjustments.

DESCRIPTION OF THE PREFERRED EMBODIMENT

Figure 2:
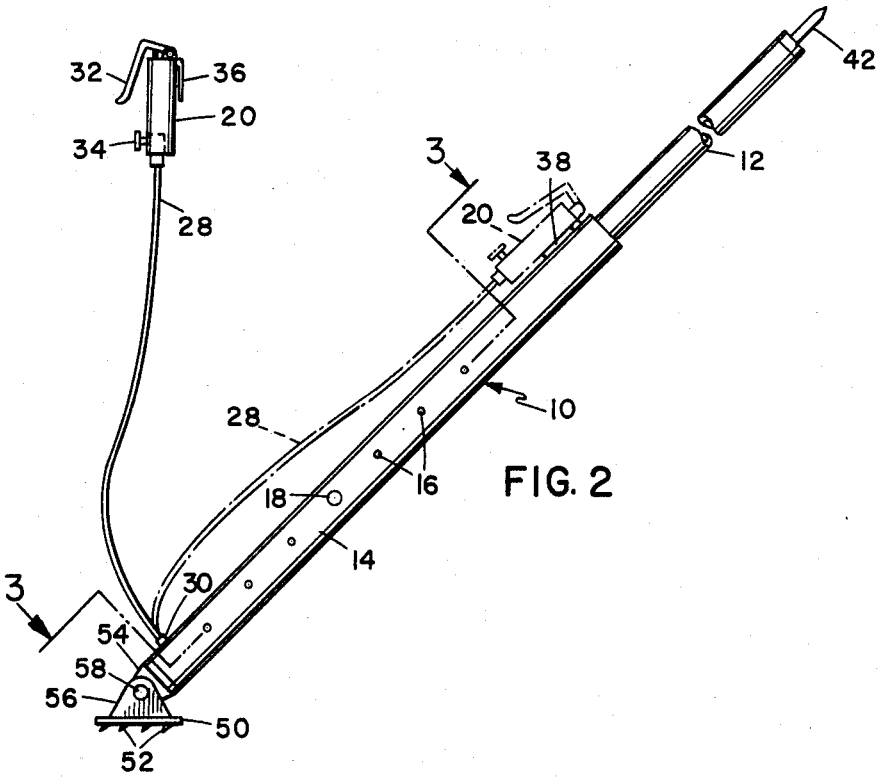
FIG. 2 is an enlarged side elevation view of the preferred embodiment of my invention illustrating alternate positions of its removable hand operated hydraulic pump.
Figure 3:
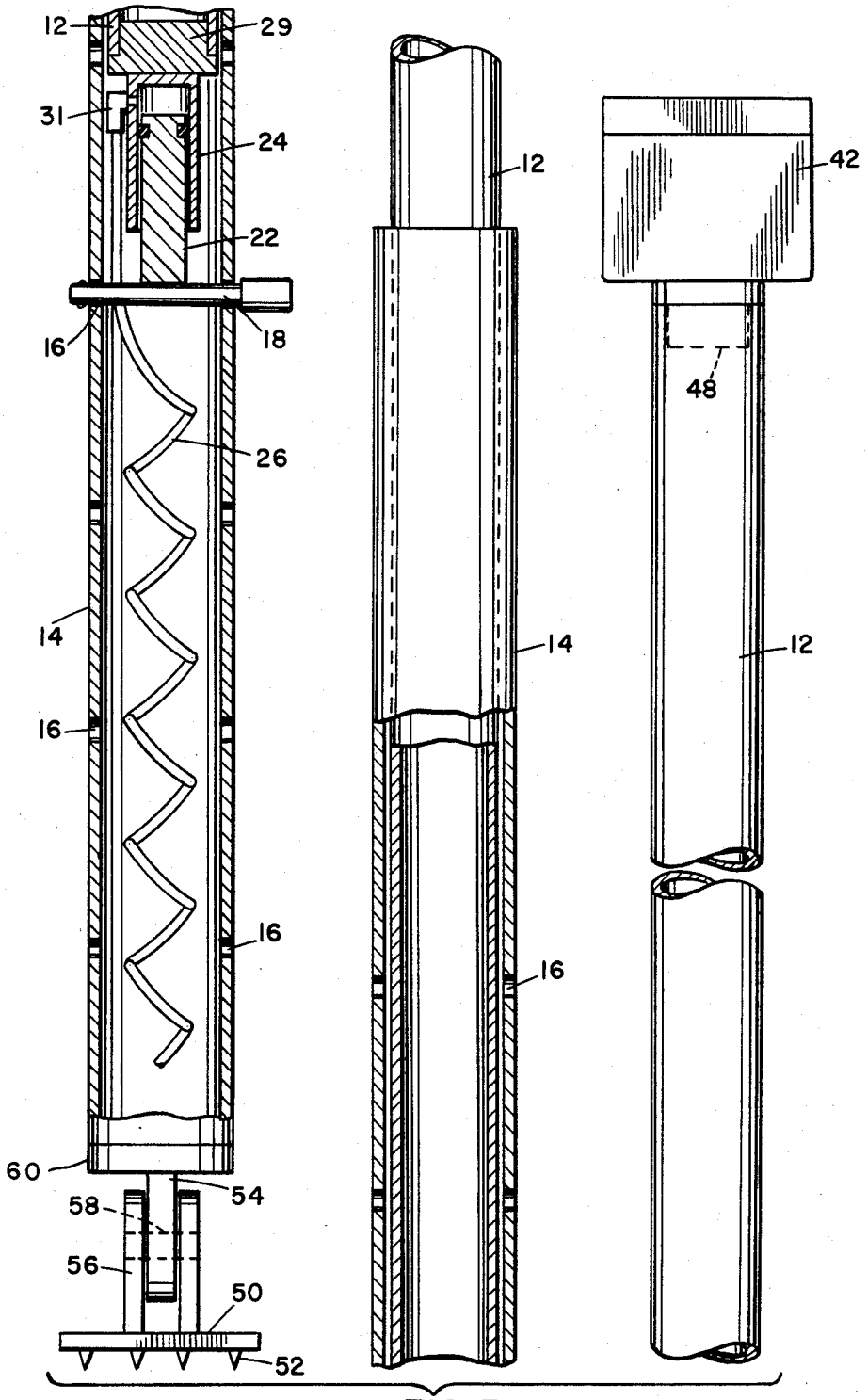
FIG. 3 is a series of enlarged, fragmentary part sectional and part elevational views taken along line 3—3 of FIG. 2.

Referring to FIG. 2, the preferred embodiment 10 of my push stick for racking stud walls inlcudes upper and lower telescoping elongate tubular members 12 and 14. The lower member 14 has a plurality of holes 16 (FIG. 3) which extend transversely therethrough for having a pin 18 inserted in a selected one thereof to establish a reference position of the upper tubular member 12 relative to the lower tubular member 14. This establishes an overall length of the device suitable for spanning the diagonal distance between the floor and the upper portion of the stud wall to be plumbed or lined and allows the device to be used with walls of different heights. By way of example, the tubular members 12 and 14 may be constructed of lightweight aluminum pipe.

The apparatus further includes jack means for causing progressive extension and retraction of the upper tubular member 12 relative to the lower tubular member 14 in minute, successive increments. In the preferred embodiment the jack means includes a hand operated hydraulic pump 20 (FIG. 2), a hydraulic piston 22 (FIG. 3) slidable inside a cylinder 24, and conduit means in the form of hoses 26 and 28. The upper end of the cylinder 24 is connected to a plug 29 which is in turn rigidly secured in the lower end of the upper tubular member 12. Hose 26 extends downwardly inside the lower tubular member 14 where it is connected via coupling 30 (FIG. 2) to hose 28 which extends outside the lower tubular member to the pump 20. The upper end of the hose 26 (FIG. 3) inside the lower tubular member 14 is connected to the cylinder 24 via coupling 31.

The pump 20 (FIG. 2) has a hydraulic reservoir inside its main body portion for holding a quantity of a suitable hydraulic fluid. Manual reciprocation of a lever 32 of the pump forces hydraulic fluid to the cylinder 24 (FIG. 3) to gradually move the cylinder 24 upward and away from the piston 22. The lower end of the piston is engaged with and supported by the pin 18. Operation of the pump therefore causes the upper tubular member 12 to gradually extend from the lower tubular member 14. A bleed valve 34 (FIG. 2) mounted on the main body portion of the pump 20 may be manually actuated to gradually drain hydraulic fluid from the cylinder 24 to thereby allow the upper tubular member 12 to retract into the lower tubular member.

The main body portion of the pump has a hook 36 (FIG. 2) for insertion into a bracket 38 attached to the outside of the upper portion of the tubular member 14 to removably mount the pump 20 thereto as illustrated in phantom lines. The pump 20 may be detached and manually operated by a carpenter 40 (FIG. 1) remote from the telescopic tubular members 12 and 14.

A spade or blade 42 (FIG. 3) is rigidly connected to the forward end of the upper tubular member 12. This blade is pushed against a vertical stud 44 (FIG. 1) at an acute angle to provide a non-slip engagement with an upper portion of the stud wall 46. The spade may be rigidly secured to a plug 48 (FIG. 3) which is in turn tightly fit within the forward end of the upper tubular member 12.

The rear end of the device is equipped with means for providing engagement with a support surface such as a wooden floor or a sill board laid horizontally on top of a concrete floor. In the illustrated embodiment a base 50 having a plurality of sharp projections 52 extending from a lower side thereof is pivotally mounted to the rearward end of the lower tubular member 14 via flange 54, trunnion 56 and pin 58. The flange is rigidly secured to cap 60 which is in turn rigidly secured to the end of the tubular member 14. This toothed base engages a plywood floor in a manner that will resist slippage as the diagonally positioned push stick is used to move the upper portion of a stud wall. A temporary board (not illustrated) may have to be laid to the left of the device so that one end contacts the base 50 and the other end contacts another abutment. Alternatively, the base 50 may have a hole therein for having a temporary nail driven therethrough to anchor the device to a concrete or wooden floor.

Figure 1:
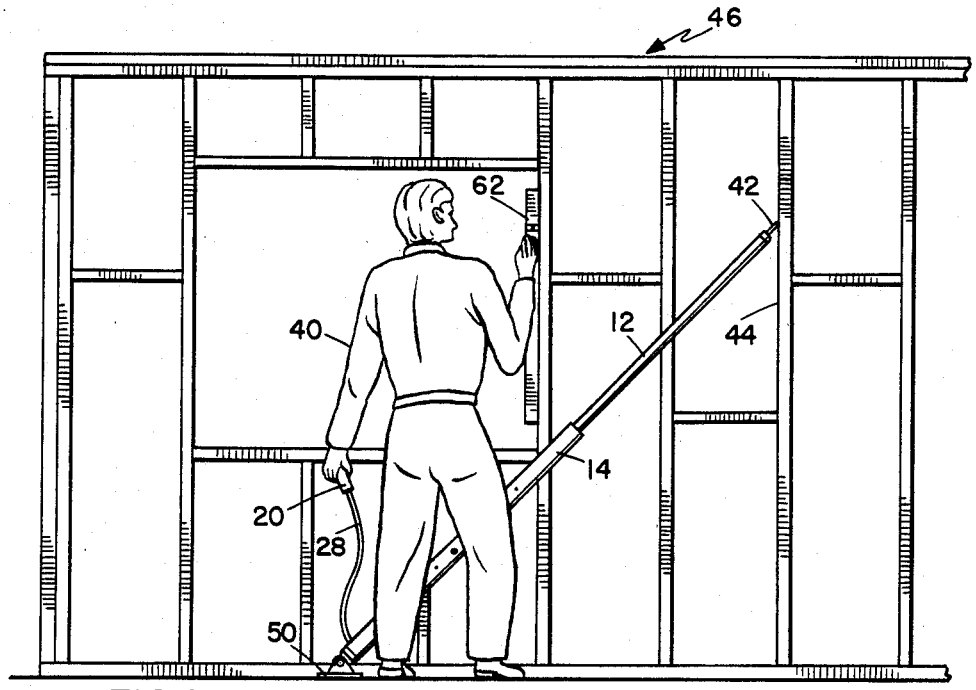
FIG. 1 illustrates a preferred embodiment of my invention being used by a lone carpenter to safely plumb a stud wall.

The use of the preferred embodiment of my push stick will now be briefly described in conjunction with FIG. 1. The pin 18 is removed and the tubular members 12 and 14 are telescoped so establish an overall length suitable for extending at approximately a forty-five degree angle between the upper portion of the stud wall 46 and the floor. The pin is then re-inserted into the appropriate hole 16 to fix this overall length. The carpenter 40 then engages the blade.42 with the stud 44 adjacent the upper end thereof after positioning the base 50 on the floor a suitable distance away. The carpenter then operates the pump 20 with his left hand while monitoring the orientation of the wall via level 62 placed against another stud 64 of the wall. Each depression of the pump lever moves the wall a small increment and the carpenter stops pumping when precise vertical orientation has been achieved as indicated by observing the level 62 directly. If the carpenter overshoots, he simply dépresses the bleed valve 34 on the pump to retract the upper tubular member, pulls back on the wall a slight amount and pumps again. Before doing the next plumb or line operation, it may be necessary to retract the upper tubular member again to provide adequate range of extension of the hydraulic piston and cylinder.

Having described a preferred embodiment of my push stick it will be apparent to those skilled in the art that my invention may be modified in arrangement and detail. Therefore the protection afforded my invention should only be limited in accordance with the scope of the following claims.

I claim:

1. An apparatus for applying a force for the alignment of a framed stud wall, comprising:

a first elongated tubular member;

a second elongated tubular member;

a rear portion of the first member being telescopically received in and connected to a forward portion of the second member for permitting relative movement between the members along a common longitudinal axis;

pin and hole means in said second tubular member for establishing a reference position of the first tubular member relative to the second tubular member;

manually operable hydraulic jack means including a hydraulic piston and cylinder assembly forming the rearward end of the first tubular member for longitudinally moving of the first member from the reference position in successive small increments;

means connected to a forward end of the first member for engaging a portion of the stud wall; and means connected to a lower end of the second member for engaging a floor level support surface.

2. An apparatus according to claim 1 wherein the jack means further includes a reservoir, a quantity of hydraulic fluid in the reservoir, and a hand operated pump for delivering the hydraulic fluid to the piston and cylinder assembly, elongated flexible conduit means, at least a portion of which extends along the interior of said second tubular member, for connecting the pump to the piston and cylinder assembly and means for removably mounting the pump to the second tubular member for enabling selectively in position operation and remote positioning and operation of the pump.

3. An apparatus according to claim 2 wherein the jack means further includes valve means on the pump actuable for bleeding hydraulic fluid from the piston and cylinder assembly to the reservoir.

4. An apparatus according to claim 1 wherein the means for engaging the portion of the stud wall comprises a generally planar blade element having a sharpened edge for engaging a stud surface.

5. An apparatus according to claim 1 wherein the means for engaging the floor level support surface comprises a base and means for pivotally attaching the base and the lower end of the second member.

6. An apparatus according to claim 5 wherein the base member has a plurality of pointed projections for non-slip engagement with a wooden floor.

7. An apparatus for performing plumb and line adjustment of a generally vertically oriented stud wall, comprising:

telescopically movable first and second elongate tubular members dimensioned for extending diagonally between an upper portion of the stud wall and a floor supporting the stud wall, a rear portion of the first tubular member extending within a forward portion of the second tubular member;

transverse pin and hole means in said second tubular member for establishing a selected one of a plurality of reference positions of the first tubular member relative to the second member;

manually operable hydraulic jack means including a cylinder mounted on the rear portion of said first tubular member and a piston in said cylinder and engaging said pin for progressively extending of the first tubular member with respect to the reference position;

means connected to a forward end of the first member for non-slip engagement with the upper portion of the stud wall; and means connected to a rearward end of the second member for non-slip engagement with the floor or a sill extending along the floor.

8. An apparatus according to claim 7 wherein the jack means includes a hydraulic piston and cylinder mounted at a rear end of the first tubular member and a hand operated pump connected for delivering a hydraulic fluid to the cylinder, conduit means connecting the pump and the cylinder for enabling the pump to be selectively positioned and hand operated remote from the tubular members.

9. An apparatus according to claim 8 wherein the means for non-slip engagement with the stud wall includes a spade blade having a sharpened straight edge.

10. An apparatus according to claim 8 wherein the means for non-slip engagement with the floor or sill includes a base having a plurality of sharp projections for biting into a wooden floor.

11. An apparatus according to claim 10 wherein the means for non-slip engagement with the floor or sill further includes means for pivotally connecting the base to the rearward end of the second member.

12. An apparatus according to claim 8 wherein the first and second tubular members each have a round cross-section.

13. An apparatus according to claim 8 wherein the conduit means extends longitudinally inside the second tubular member to a location adjacent the rear end thereof and then outside the second tubular member to the pump.

14. A push stick for performing plumb and line functions on a generally vertically oriented stud wall, comprising:

first and second elongate tubular members engaged for relative telescopic movement and dimensioned for extending diagonally betwen an upper portion of the stud wall and a floor supporting the stud wall, a rear portion of the first member extending within a forward portion of the second member;

means for establishing a reference position of the first member relative to the second member, including a plurality of longitudinally spaced transverse holes in said second tubular member and a pin insertable in a selected one of the holes;

jack means for generating a progressive extension of the first member with respect to the reference position, including a hydraulic piston and cylinder assembly having the cylinder mounted to a rear end of the first tubular member with the piston positioned in the cylinder and for engagement with the pin, a reservoir, a quantity of hydraulic fluid in the reservoir, a manually operable pump, conduit means, at least a portion of which extends along the interior of said second tubular member, for operatively coupling the pump and reservoir to the cylinder, and means for removably mounting the pump to the second tubular member for enabling selective operation on said second tubular member and remote operation thereof;

a generally planar blade connected to a forward end of the first tubular member and having a sharpened edge for non-slip engagement with the upper portion of the stud wall; and a base having a plurality of pointed projections and means for pivotally connecting the base to a rearward end of the second member for non-slip engagement with the floor.

* * * * *